US007234958B1

(12) United States Patent
Copus

(10) Patent No.: US 7,234,958 B1
(45) Date of Patent: Jun. 26, 2007

(54) CABLE RETENTION APPARATUS

(75) Inventor: Charles R. Copus, Lawrenceville, GA (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 11/380,436

(22) Filed: Apr. 27, 2006

(51) Int. Cl.
*H01R 13/62* (2006.01)

(52) U.S. Cl. ..... 439/371

(58) Field of Classification Search ..... 439/373, 439/371, 449, 458, 345, 448, 457
See application file for complete search history.

(56) References Cited

U.S. PATENT DOCUMENTS 2,461,427 A * 2/1949 Kneebone ..... 439/369
3,781,761 A * 12/1973 Harwood ..... 439/369
3,838,383 A * 9/1974 Wilbur et al. ..... 439/472
4,475,785 A * 10/1984 Muller et al. ..... 439/298
5,423,693 A * 6/1995 Light ..... 439/369
6,979,221 B1 * 12/2005 Hunter ..... 439/369
7,081,004 B1 * 7/2006 Puzio ..... 439/369

* cited by examiner

*Primary Examiner*—Phuong Dinh
(74) *Attorney, Agent, or Firm*—Maginot, Moore & Beck; Paul Martin

(57) ABSTRACT

A cable retention apparatus. The cable retention apparatus includes a sheet member containing a first aperture suitable for surrounding a first connector, and at least one additional second aperture having inside dimensions which generally correspond to outside dimensions of a cable to be retained. The cable extends from one side of the sheet member through the second aperture to another side of the sheet member. The sheet member provides strain relief to maintain coupling between a second connector on the cable and the first connector.

12 Claims, 2 Drawing Sheets

CABLE RETENTION APPARATUS

BACKGROUND

Cable connectors can disengage and cross engage with very little force from their corresponding connectors on printed circuit boards.

It would be desirable to provide a cable retention apparatus to prevent disengagement from normal wear and tear.

SUMMARY

In accordance with the present invention, a cable retention apparatus is provided.

The cable retention apparatus includes a sheet member containing a first aperture suitable for surrounding a first connector, and at least one additional second aperture having inside dimensions which generally correspond to outside dimensions of a cable to be retained. The cable extends from one side of the sheet member through the second aperture to another side of the sheet member. The sheet member provides strain relief to maintain coupling between a second connector on the cable and the first connector.

DETAILED DESCRIPTION

Figure 1:
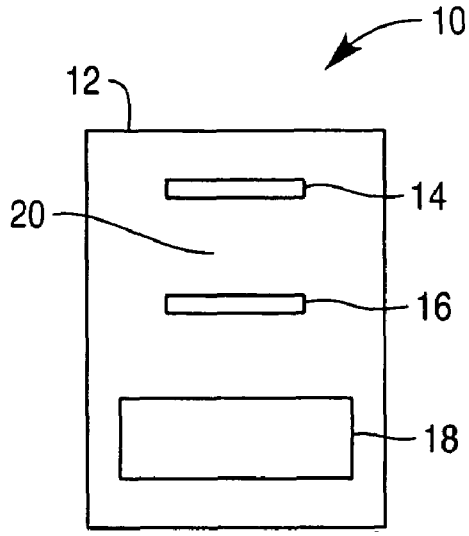
FIG. 1 is a view of the cable retention apparatus.

Referring to FIG. 1, example cable retention apparatus 10 includes sheet member 12 having a number of apertures.

Figure 3:
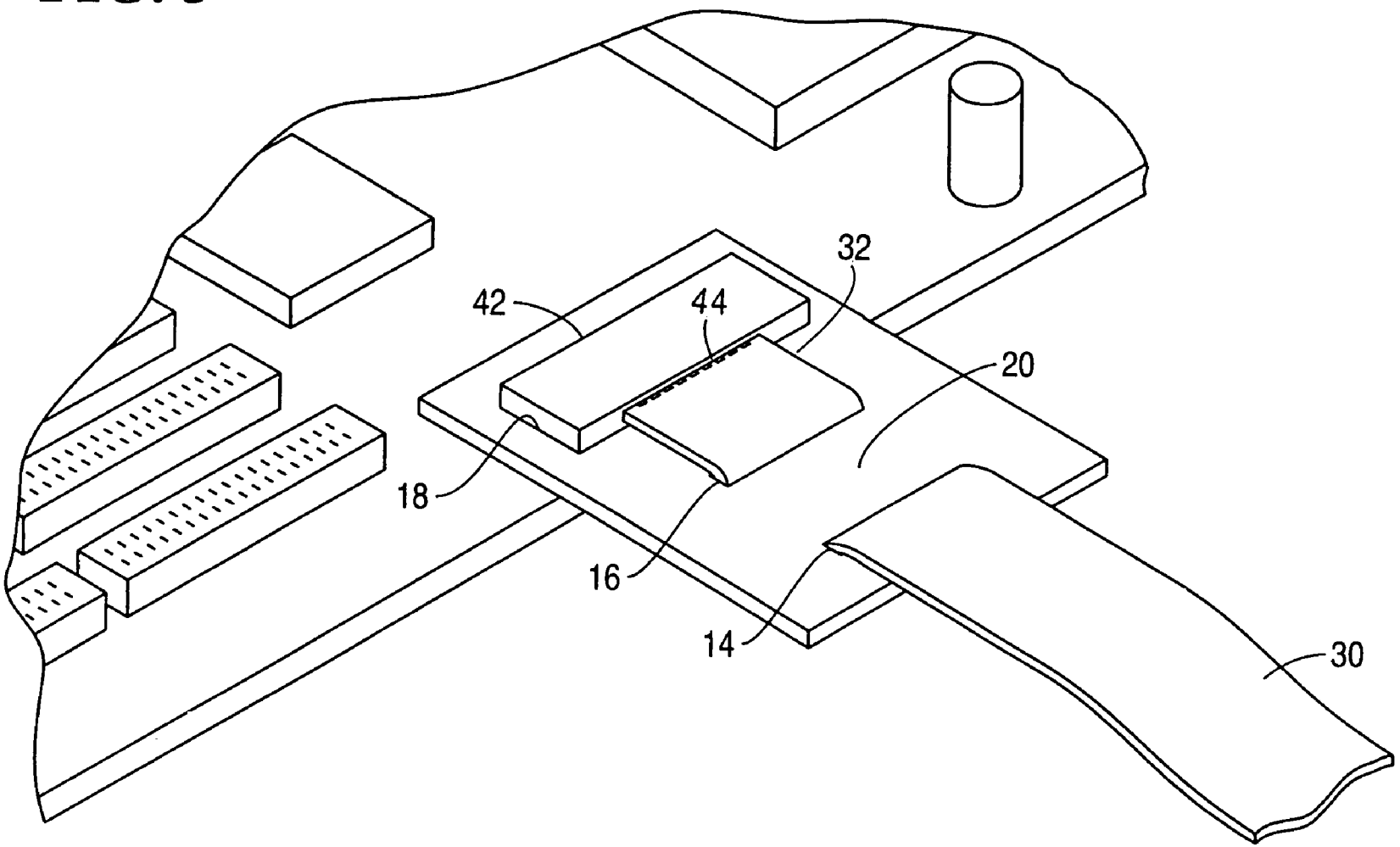

Sheet member 12 may be made of a non-conductive material, such as plastic. The material may have some flexibility in order to facilitate a friction fit between sheet member 12 and connector 42 (FIG. 3). A rigid material may be used; however, an adhesive may be necessary to hold sheet member 12 in place around connector 42 if connector 42 is facing in a downward direction.

Figure 2:
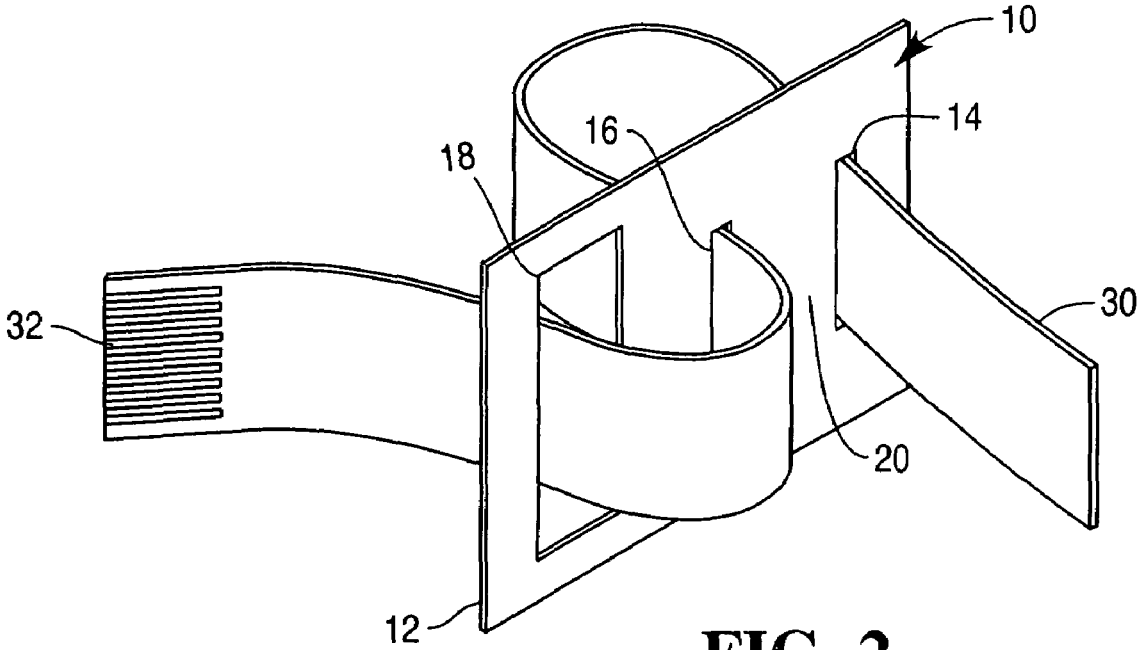
FIGS. 2 and 3 illustrate use of the cable retention apparatus in connection with an example cable.

Sheet member 12 may have two or more apertures. The example cable retention apparatus 10 includes three apertures 14, 16, and 18. Apertures 14 and 16 have inside dimensions that closely correspond to outside dimensions of a cable 30 (FIG. 2). Tolerances are about ±0.010 inch. Apertures 14 and 16 are separated by a section 20.

Aperture 18 has an inside dimension that closely corresponds to the outside dimensions of connector 42. Tolerances are about ±0.010 inch for a friction fit between sheet member 12 and connector 42.

With reference to FIG. 2, example cable retention cable retention apparatus 10 is applied to an example cable 30, which includes a generally flat flexible cable. The inside dimensions of apertures 14 and 16 generally correspond to the outside dimensions of the flat flexible cable.

Connector 32 of cable 30 is inserted through aperture 14 from one side of apparatus 10, routed through aperture 16 from the other side of apparatus 10, and then routed through aperture 18 from the one side of apparatus 10.

With reference to FIG. 3, connector 32 is inserted into a slot 44 of the connector 42. Connector 42 may be located on a printed circuit board 40 as illustrated, or located elsewhere. Connector 42 may include a zero insertion force (ZIF) connector as applied to flexible cables, or other type of connector as applied to other types of cables. Connector 32 of cable 30 may include exposed conductive elements of a flexible cable or other type of connector.

Cable retention apparatus 10 is applied to connector 42 and positioned so that aperture 18 surrounds connector 42. Connector 42 retains cable retention apparatus 10 through aperture 18. Slack is removed from cable 30. Section 20 between apertures 14 and 16 applies frictional pressure to cable 30 so as to retain connector 32 in connector 42. As such, cable retention apparatus 10 provides strain relief to retain connector 32 in connector 42.

Although particular reference has been made to certain embodiments, variations and modifications are also envisioned within the spirit and scope of the following claims.

What is claimed is:

1. A cable retention apparatus comprising:

a sheet member containing a first aperture suitable for surrounding a first connector; and at least one additional second aperture having inside dimensions which generally correspond to outside dimensions of a cable to be retained;

wherein the cable extends from one side of the sheet member through the second aperture to another side of the sheet member; and wherein the sheet member provides strain relief to maintain coupling between a second connector on the cable and the first connector.

2. The apparatus of claim 1, wherein the sheet member comprises three apertures, and wherein the cable extends from one side of the sheet member through the third aperture to another side of the sheet member and then through the second aperture to the one side of the sheet member.

3. The apparatus of claim 1, wherein the first aperture is sized to facilitate a friction fit between the first aperture and the first connector.

4. The apparatus of claim 1, wherein the sheet member is made of a non-conductive material.

5. The apparatus of claim 4, wherein the sheet member is made of plastic.

6. A cable retention apparatus comprising:

a sheet member containing a first aperture suitable for surrounding a zero insertion force connector on a printed circuit board; and second and third apertures having inside dimensions which generally correspond to outside dimensions of a flexible cable to be retained;

wherein the cable extends from one side of the sheet member through the third aperture to another side of the sheet member and then through the second aperture to the one side of the sheet member; and wherein the sheet member provides strain relief to maintain coupling between conductive elements on the flexible cable and the zero insertion force connector on the printed circuit board.

7. A cable retention apparatus comprising:

a sheet member;

a first aperture in the sheet member configured to allow a first portion of a connector to be passed therethrough; and a second aperture in the sheet member configured to receive a cable, such that when the first portion of the connector has been passed through the first aperture and the cable is received by the second aperture and the cable is coupled with the connector, a force applied to the cable is transferred through the sheet member to the connector.

8. The cable retention apparatus of claim 7, wherein the first aperture is configured to frictionally engage a second portion of the connector.

9. The cable retention apparatus of claim 8, wherein:

the sheet member defines a plane which passes through both the first aperture and the second aperture; and the first aperture is substantially rectangular in the plane of the sheet member.

10. The cable retention apparatus of claim 9, wherein the second aperture is substantially rectangular in the plane of the sheet member.

11. The cable retention apparatus of claim 7, wherein:

the sheet member defines a plane which passes through both the first aperture and the second aperture; and the second aperture is substantially rectangular in the plane of the sheet member.

12. The cable retention apparatus of claim 7, further comprising:

a third aperture a in the sheet member configured to receive the cable, wherein the third aperture is substantially rectangular in the plane of the sheet member.

* * * * *